US008028509B2

(12) United States Patent
Okumura et al.

(10) Patent No.: US 8,028,509 B2
(45) Date of Patent: Oct. 4, 2011

(54) POLYETHYLENE NAPHTHALATE FIBER AND METHOD FOR PRODUCING THE SAME

(75) Inventors: Hisao Okumura, Matsuyama (JP); Fuyuki Terasaka, Matsuyama (JP)

(73) Assignee: Teijin Fibers Limted, Osaka (JP)

( * ) Notice: Subject to any disclaimer, the term of this patent is extended or adjusted under 35 U.S.C. 154(b) by 111 days.

(21) Appl. No.: 12/528,947

(22) PCT Filed: Feb. 20, 2008

(86) PCT No.: PCT/JP2008/052883

§ 371 (c)(1),
(2), (4) Date: Aug. 27, 2009

(87) PCT Pub. No.: WO2008/105297

PCT Pub. Date: Sep. 4, 2008

(65) Prior Publication Data

US 2010/0101202 A1 Apr. 29, 2010

(30) Foreign Application Priority Data

Feb. 28, 2007 (JP) ..... 2007-049137

(51) Int. Cl.
*D02G 3/02* (2006.01)

(52) U.S. Cl. ..... 57/243

(58) Field of Classification Search ..... 57/243, 57/244; 152/451; 428/364
See application file for complete search history.

(56) References Cited

U.S. PATENT DOCUMENTS

| | | | | |
|---|---|---|---|---|
| 5,466,525 | A * | 11/1995 | Maria et al. | 428/357 |
| 5,607,757 | A | 3/1997 | Dalton | |
| 6,511,747 | B1 * | 1/2003 | Cho et al. | 428/364 |
| 6,955,854 | B2 * | 10/2005 | Kwon et al. | 428/364 |
| 2004/0265578 | A1 | 12/2004 | Kwon et al. | |
| 2006/0180261 | A1 | 8/2006 | Kwon et al. | |
| 2007/0116951 | A1 | 5/2007 | Kwon et al. | |

FOREIGN PATENT DOCUMENTS

| | | | |
|---|---|---|---|
| EP | 1 493 852 | A1 | 1/2005 |
| JP | 4194021 | A | 7/1992 |
| JP | 6128810 | A | 5/1994 |
| JP | 11228695 | A | 8/1999 |
| JP | 2003193330 | A | 7/2003 |
| JP | 2005-023505 | A | 1/2005 |
| JP | 2006-500479 | A | 1/2006 |
| JP | 2006-322098 | A | 11/2006 |
| JP | 2006-322110 | A | 11/2006 |

* cited by examiner

*Primary Examiner* — Shaun R Hurley

(74) *Attorney, Agent, or Firm* — Sughrue Mion, PLLC

(57) ABSTRACT

The polyethylene naphthalate fiber for industrial material having a low fatigue in a composite is a polyethylene naphthalate fiber for industrial material containing an ethylene-2, 6-naphthalate unit in 80% or more, characterize by having a strength of 6 cN/dtex or more and a secondary yield point elongation degree of 8% or less. The production method thereof is a method for producing a fiber in which a fiber having been obtained by melt-spinning a polyethylene naphthalate is subjected to stretching, characterized in that prestretch satisfying such conditions as the fiber temperature of from 80° C. to 120° C. and from 0.05 to 0.3 N/dtex is performed, a first stretch satisfying such conditions as the fiber temperature of from 130° C. to 180° C. and stretch tensile force of not more than the prestretch tensile force is performed, the total stretch magnification including subsequent stretches is set to 5 or more, and finally heat-treatment under tension with a stretch ratio of from 0 to 2% is performed.

15 Claims, 1 Drawing Sheet

POLYETHYLENE NAPHTHALATE FIBER AND METHOD FOR PRODUCING THE SAME

TECHNICAL FIELD

The present invention relates to a polyethylene naphthalate fiber for industrial material with a low fatigue deterioration in a composite, a method for producing the same, and a polyethylene naphthalate fiber cord for industrial material using the same, which are useful for industrial material and the like.

BACKGROUND ART

A polyethylene naphthalate fiber including an ethylene-2,6-naphthalate unit as the main constituent shows a high strength, high elastic modulus and excellent thermal dimensional stability, and is a highly useful fiber as an industrial material. Particularly, in a field of composites that are reinforced by a polyethylene naphthalate fiber, in particular rubber reinforcing materials and the like including a tire cord, it is expected as a material that exhibits performance exceeding a polyethylene telephthalate fiber that is generally used currently.

However, the molecule of a polyethylene naphthalate fiber is stiff and tends to be oriented in a fiber axis direction. Therefore, it has such drawback that, in the case where only high magnification stretch and heat treatment are performed, fatigue properties for repeating stress is lower as compared with other general-purpose synthetic fibers and mechanical properties under real use conditions is lowered.

In order to solve such problems, for example, Patent Document 1 discloses a polyethylene naphthalate fiber having a large Silk factor, which is obtained as (strength)×(square root of elongation degree), and a method for producing the same by defining stretch conditions of a first stage and a second stage. Patent Document 2 discloses a method for producing polyethylene naphthalate with an excellent toughness by defining conditions of a spinning cylinder just after spinning to delayed-cool the discharged yarn. However, there is a limitation on increasing the toughness of raw yarns, and it is important to improve fatigue properties of fibers in order to enhance the mechanical performance in a composite at real use.

For fatigue resistant properties, Patent Documents 3 and disclose polyethylene naphthalate fiber formed by copolymerizing a cyclic acetal or a bis-(trimellitimide) compound. However, although fatigue properties are improved by copolymerizing such a bulky third component, there is such a drawback that the strength thereof lowers because fiber structure is disturbed. Therefore the fiber could not be substantially applied to a fiber for rubber reinforcement such as tire cords.

Patent Document 1: JP-A-4-194021
Patent Document 2: JP-A-6-128810
Patent Document 3: JP-A-2003-193330
Patent Document 4: JP-A-11-228695

DISCLOSURE OF THE INVENTION

Problems that the Invention is to Solve

With the view of such actual states, the purpose of the present invention is to provide a polyethylene naphthalate fiber for industrial material having low fatigue in composites, a method for producing the fiber, and a polyethylene naphthalate fiber cord for industrial material using the fiber.

Means for Solving the Problems

The polyethylene naphthalate fiber of the invention for industrial material is characterized by being a polyethylene naphthalate fiber that includes an ethylene-2,6-naphthalate unit in 80% or more, and that has 6 cN/dtex or more of strength and 8% or less of a secondary yield point elongation degree, and from 0.1 to 0.5 cN/dtex of the terminal modulus, which is the difference between the rupture stress and a stress at an elongation degree before the rupture by 1%.

Further, the difference between the secondary yield point elongation degree and the rupture elongation degree is preferably from 2 to 10%. In addition, it is preferable that an intermediate load elongation degree at 4.0 cN/dtex is from 2 to 4%, the thermal contraction ratio at 180° C. is from 3 to 7% and the rupture elongation degree is from 8 to 20%.

The method of the invention for producing a polyethylene naphthalate fiber for industrial material is a method for producing a polyethylene naphthalate fiber in which a fiber obtained by melt-spinning polyethylene naphthalate including an ethylene-2,6-naphthalate unit in 80% or more is subjected to multistage elongation without being once wound, wherein the method is characterized by performing prestretch satisfying such conditions that the fiber temperature is from 80° C. to 120° C. and the prestretch tensile force is from 0.5 to 3.0 cN/dtex between a takeoff roller and a first stretch roller, performing a first stretch under such conditions that the fiber temperature is from 130° C. to 180° C. and stretch tensile force is not more than the prestretch tensile force between the first stretch roller and a second stretch roller at the first stretch, making the total stretch magnification including subsequent stretches 5 or more, and finally performing heat-treatment under tension with a stretch ratio of from 0 to 2%.

Further, it is also preferable that the stretch tensile force at the first stretch is in the range of from 15 to 80% of the prestretch tensile force, the value thereof is from 0.1 to 0.6 cN/dtex or the stretch speed is from 2000 to 4000 m/min. In addition, it is also preferable that a heating zone exists just beneath a spinneret, the zone having a length of 300 mm or less, the spinning speed is from 300 to 800 m/min and the birefringence index $\Delta n$ of a fiber before the stretch is from 0.001 to 0.01.

A polyethylene naphthalate fiber cord for industrial material, which is another invention, is characterized by being a multifilament composed of the above-described polyethylene naphthalate fiber for industrial material, wherein it is preferable that the surface of the multifilament is given an adhesive treatment agent, the adhesive treatment agent is a resorcin-formalin latex adhesive agent and the number of twists of the multifilament is from 50 to 1000 turn/m.

The fiber/polymer composite of the invention is characterized in that it includes the above-described polyethylene naphthalate fiber for industrial material and a polymer, wherein the polymer is further preferably a rubber elastic body.

According to the invention, there are provided a polyethylene naphthalate fiber for industrial material showing low fatigue in a composite, a production method thereof, and a polyethylene naphthalate fiber cord for industrial material using the fiber.

DESCRIPTION OF THE REFERENCE NUMERALS AND SIGNS

Figure 1:
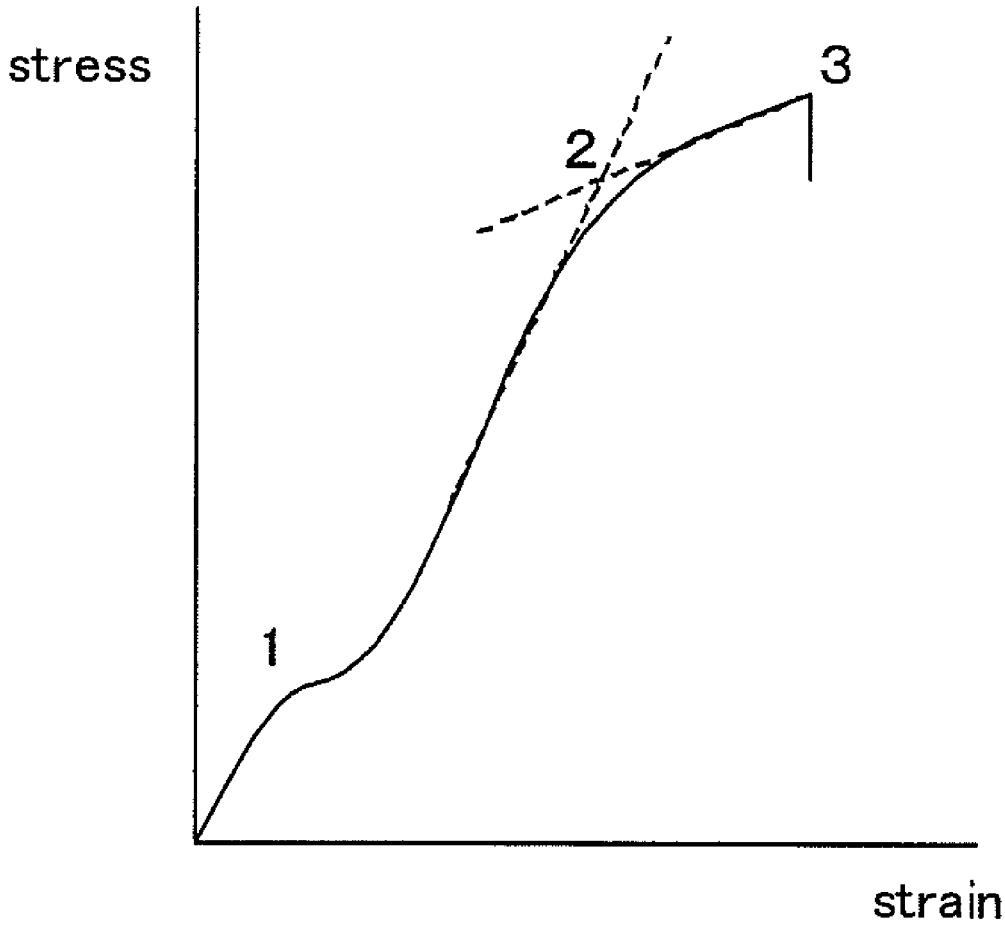
FIG. 1 is a graph of a load elongation degree curve for obtaining the secondary yield point.

1: primary yield point
2: secondary yield point
3: rupture point

BEST MODE FOR CARRYING OUT THE INVENTION

The polyethylene naphthalate fiber of the invention for industrial material is a polyethylene naphthalate fiber that includes an ethylene-2,6-naphthalate unit in 80% or more, and that has 6 cN/dtex or more of strength, 8% or less of a secondary yield point elongation degree and from 0.1 to 0.5 cN/dtex of the terminal modulus, which is the difference between the rupture stress and a stress at an elongation degree before the rupture by 1%.

Here, the polyethylene naphthalate in the invention may only include an ethylene-2,6-naphthalate unit in 80% by mol or more, and may be a copolymer that includes an appropriate third component at a ratio of 20% by mol or less, preferably 10% by mol or less. Generally, polyethylene-2,6-naphthalate is synthesized by polymerizing naphthalene-2,6-dicarboxylic acid or a functional derivative thereof in the presence of a catalyst under appropriate reaction conditions. At this time, by adding one kind or two or more kinds of appropriate third components before the completion of polymerization of polyethylene-2,6-naphthalate, copolimerized polyethylene naphthalate is synthesized.

Examples of the appropriate third component include (a) compounds having two ester-forming functional groups including aliphatic dicarboxylic acids such as oxalic acid, succinic acid, adipic acid, sebacic acid and dimer acid; alicyclic dicarboxylic acids such as cyclopropanedicarboxylic acid, cyclobutanedicarboxylic acid and hexahydroterephthalic acid; aromatic dicarboxylic acids such as phthalic acid, isophthalic acid, naphthalene-2,7-dicarboxylic acid and diphenyldicarboxylic acid; carboxylic acids such as diphenylether dicarboxylic acid, diphenylsulfone dicarboxylic acid, diphenoxyethane dicarboxylic acid and sodium 3,5-dicarboxybenzenesulfonate; oxycarboxylic acids such as glycol acid, p-oxybenzoic acid and p-oxyethoxybenzoic acid; oxy compounds such as propylene glycol, trimethylene glycol, diethylene glycol, tetramethylene glycol, hexamethylene glycol, neopentylene glycol, p-xylylene glycol, 1,4-cyclohexane dimethanol, bisphenol A, p,p'-diphenoxysulfone-1,4-bis(β-hydroxyethoxy)benzene, 2,2-bis(p-β-hydroxyethoxyphenyl)propane, polyalkylene glycol and p-phenylene-bis(dimethylcyclohexane), and functional derivatives thereof; and highly polymerized compounds derived from the above-described carboxylic acids, oxycarboxylic acids, oxy compounds and functional derivatives thereof, and (b) compounds having one ester-forming functional group such as benzoic acid, benzoylbenzoic acid, benzyloxybenzoic acid and methoxypolyalkylene glycol.

Further, (c) compounds having three or more ester-forming functional groups such as glycerine, pentaerythritol and trimethylolpropane may be used within a range that results in a substantially linear polymer.

In addition, needless to say, the polyester may be incorporated with additives including a delustering agent such as titanium dioxide, and a stabilizer such as phosphoric acid, phosphorous acid and esters thereof.

The polyethylene naphthalate fiber of the invention for industrial material is a polyethylene naphthalate fiber as described above, wherein it indispensably has 7 cN/dtex or more of strength, and 8% or less of secondary yield point elongation degree. Here, the secondary yield point elongation degree is a value of the elongation degree (strain) at the second inflexion point (secondary yield point) in a stress-strain curve (load elongation curve) when a fiber is subjected to a tensile test. The tensile test is performed under such measurement conditions as clamping length of 25 cm and drawing speed of 30 cm/min. The secondary yield point elongation degree is preferably 3% or more, further preferably in the range of from 4 to 6%.

Further, the difference between the secondary yield point elongation degree and the rupture elongation degree is preferably in the range of from 2 to 10%, further preferably in the range of from 4.0 to 9.0%.

Although the physical correlation between the secondary yield point elongation degree or the strain ratio from the secondary yield to the rupture, and cord fatigue properties is not clear, it is considered that a fiber which ruptures immediately after passing the second yield has a stiff molecular structure and the correlation between molecules lowers due to flexing fatigue in a composite to tend to generate fibrillation. On the other hand, when the width from the secondary yield point to the rupture is too great, intermediate elongation degree tends to increase. Therefore, tensile resistance when being used for rubber reinforcement decreases, which is not preferable.

In addition, the terminal modulus of the polyethylene naphthalate fiber of the invention for industrial material is indispensably in the range of from 0.1 to 0.5 cN/dtex. Here, the terminal modulus is the difference between a stress at an elongation degree before the rupture by 1% and the rupture stress when a fiber is subjected to a tensile test. The tensile test is performed under such measurement conditions as clamping length of 25 cm and speed of 30 cm/min. Further preferably it is from 0.22 to 0.48 cN/dtex. A too small terminal modulus tends to result in low strength, and a too great terminal modulus results in a fiber with poor fatigue properties because the difference between the secondary yield elongation degree and the rupture elongation degree becomes small.

Furthermore, the polyethylene naphthalate fiber of the invention for industrial material has an elongation degree of preferably from 8 to 20%, further preferably from 8.0 to 13.0%, at an intermediate load elongation with a load of 4.0 cN/dtex. A too low intermediate load elongation degree lowers fatigue properties, and a too high one degrades the dimensional stability when the fiber is used as a fiber for reinforcement, which are not preferable.

The thermal contraction ratio is preferably from 3 to 7%. Here, the thermal contraction ratio is a dry thermal contraction ratio measured at 180° C. A too great thermal contraction ratio tends to deteriorate molding properties as a composite to make handling difficult.

Rupture elongation degree is preferably from 8 to 20%, most suitably 13% or less. A too small rupture elongation degree lowers toughness of a fiber, and a too great rupture elongation degree generally lowers strength, which are not preferable.

Regarding the strength, 6 cN/dtex or more is indispensable. A higher strength is more preferable, and a too low strength also tends to result in a lowered durability as a fiber for industrial material. The strength is more preferably in the range of from 7 to 13 cN/dtex, most preferably in the range of from 7.5 to 8.8 cN/dtex.

The Silk factor, which is defined by (strength(cN/dtex))× (square root of elongation degree (%)), is preferably in the range of from 22 to 30, further, particularly preferably in the range of from 22 to 25. A small value of the Silk factor tends to increase the strength degradation in a yarn-twisting process and the like, which is undesirable tendency as a fiber for reinforcement.

Further, the polyethylene naphthalate fiber cord for industrial material, which is another invention, is one wherein the polyethylene naphthalate fiber for industrial material as described above is made into a multifilament to form a cord.

Further, preferably it is twisted. By twisting a multifilament fiber, the strength utilization ratio is averaged to improve fatigue properties thereof. The number of twists is preferably in the range of from 50 to 1000 turn/m, and a cord doubled by performing ply twist and cable twist is also preferable. Furthermore, when the polyethylene naphthalate fiber of the invention constitutes a multifilament yarn, the total fineness is more preferably in the range of from 250 to 10000 dtex, particularly preferably from 500 to 4000 dtex. The number of filaments constituting a yarn before the doubling is preferably from 50 to 3000. By forming such multifilament, fatigue resistance and flexibility are further improved. A too small fineness tends to result in an inadequate strength. In contrast, a too great fineness results in such a problem that flexibility can not be obtained due to a too great thickness, and tends to generate the agglutination between single yarns at fiber spinning to make the stable production of fiber difficult.

In addition, the polyethylene naphthalate fiber cord of the invention for industrial material is preferably a cord wherein an adhesive treatment agent has been given onto the surface thereof. In particular, when a resorcin-formalin latex-based adhesive agent (RFL adhesive agent) is given, since it is excellent in adhesion properties with rubber, the cord is best for an application of reinforcing such rubber as a tire, hose and belt. Further, in the invention, as a pretreatment agent for adhesion, an epoxy compound, an isocyanate compound, an urethane compound, a polyimine compound or the like may be given to the surface of a fiber in a yarn manufacturing process or the like, and, from the standpoint of convenience of handling, an epoxy compound can particularly preferably be used.

The method for producing a polyethylene naphthalate fiber for industrial material, which is another invention, is a method for producing a polyethylene naphthalate fiber in which a fiber having been obtained by melt-spinning a polyethylene naphthalate containing an ethylene-2,6-naphthalate unit in 80% or more is subjected to multistage stretching without once being wound, wherein prestretch satisfying such conditions as the fiber temperature of from 80° C. to 120° C. and the prestretch tensile force of from 0.05 to 0.3 N/dtex is performed between a takeoff roller and a first stretch roller, a first stretch satisfying such conditions as the fiber temperature of from 130° C. to 180° C. and stretch tensile force of not more than the prestretch tensile force is performed between the first stretch roller and a second stretch roller at the first stretch, the total stretch magnification including subsequent stretches is set to 5 or more, and finally heat-treatment under tension with a stretch ratio of from 0 to 2% is performed. Incidentally, a fiber is gradually thinned in an actual production process of a fiber, but, in the tensile force measurement of the present application, calculation was performed by dividing an actual value of tensile force measurement by the fineness of a finally obtained fiber after the stretch.

As polyethylene naphthalate used in the invention, the aforementioned polyethylene naphthalate can be mentioned. The production method of the invention is a production method in which an unstretched fiber obtained by melt-spinning such polyethylene naphthalate is stretched. Regarding the stretch method, firstly, prestretch is performed between the takeoff roller and the first stretch roller. At this time, it is essential to satisfy such conditions as the fiber temperature of from 80° C. to 120° C. and the prestretch tensile force of from 0.5 to 3.0 cN/dtex. Further, preferably the fiber temperature is in the range of from 85 to 115° C., and the prestretch tensile force is from 0.5 to 2.0 cN/dtex. The prestretch ratio on this occasion is from 0.2 to 4%, preferably from 1 to 2%. The temperature of the takeoff roller is in the range of from 85 to 130° C., appropriately from 90 to 120° C. The secondary yield point elongation degree of a fiber to be obtained can be lowered by employing a low temperature at the prestretch, and, inversely, the secondary yield point elongation degree may be raised by employing a high temperature. In addition, the secondary yield point elongation degree of a fiber to be obtained can be lowered by employing a high prestretch tensile force, and, inversely, the secondary yield point elongation degree may be raised by employing a low prestretch tensile force.

Further, in the production method of the invention, subsequently the first stretch is performed between the first stretch roller and the second stretch roller. At this time, such conditions as the fiber temperature of from 130° C. to less than 180° C. and the first stretch tensile force of not more than the prestretch tensile force are adopted. Further, preferably the yarn temperature is in the range of from 140° C. to 170° C. and the tensile force at the stretch is in the range of from 15 to 80% of the prestretch tensile force at the prestretch, further preferably in the range of from 25 to 40%. The absolute value of tensile force at the stretch is preferably from 0.1 to 0.6 cN/dtex, further preferably in the range of from 0.2 to 0.5 cN/dtex. The first stretch is performed between the first stretch roller and the second stretch roller, therefore the temperature of the first stretch roller is preferably from 130 to 190° C., further preferably from 140 to 180° C. And, the first stretch magnification at this time is preferably from 4.2 to 5.8, further preferably from 4.5 to 5.5. By adjusting the stretch tensile force within this range, a fiber having intended physical properties can be obtained. When the stretch tensile force is on the lower side from this range, an targeted fiber strength can not be obtained, and, inversely, a too high stretch tensile strength leads to a low strength when it is formed into a dip cord, therefore it is preferably not more than 0.5 cN/dtex.

According to the production method of the invention, by satisfying such temperature and tensile force at the stretch, it is possible to produce a polyethylene naphthalate fiber that shows a little fatigue deterioration in a composite.

Further, in the production method of the invention, performing a second stretch under such a condition as fiber temperature of from 120° C. to 180° C. after the first stretch is preferable. Further preferably, the temperature is from 150° C. to less than 170° C. The second stretch is performed between a second stretch roller and a third stretch roller, therefore the second stretch roller has a temperature of preferably from 120 to 190° C., further preferably from 160 to 180° C. And, the second stretch magnification at this time is preferably from 1.02 to 1.8, further preferably form 1.10 to 1.5.

A polyethylene naphthalate fiber thus stretched may further be subjected to a third and subsequent stretches according to need. The total stretch magnification must be 5 or more in order to achieve the strength, and is preferably around 7 as the upper limit. High strength can be expressed by heightening the stretch magnification, but a too high stretch magnification results in frequent occurrence of yarn breakage not to allow a fiber to be produced.

In addition, in the production method of the invention, it is indispensable to perform heat-treatment under tension at a stretch ratio of from 0 to 2% after the stretch and prior to winding. The stretch without relaxation makes it possible to assure high fatigue resistance. Heat set temperature is preferably from 200 to 250° C., and the set temperature can be adjusted so that the thermal contraction ratio of a stretched yarn at 180° C. becomes from 3 to 7%.

In the production method of the invention, the stretch is performed as described above, wherein the stretch speed is preferably from 2000 to 4000 m/min, further preferably from 2500 to 3500 m/min. Keeping the speed high makes it possible to prevent the temperature down of the fiber and to perform the treatment under a constant condition. In addition, the production method of the invention presupposes to adopt a direct stretch method in which the stretch is performed without winding after fiber spinning. Although the reason is not definite, a so-called separated stretch system, in which an unstretched yarn is once wound and then stretched, cannot exert the effect of the production method of the invention.

In addition, it is preferable to provide a heating zone having a length of 300 mm or less just after the melt spinning of a fiber of before the stretch. The heating zone preferably has the temperature of from 350 to 450° C. By performing delayed cooling in such a manner, the fiber strength can further be enhanced.

The fiber spinning speed is preferably from 300 to 800 m/min, further preferably from 400 to 600 m/min. The birefringence index Δn of an unstretched fiber is preferably from 0.001 to 0.01. A too low birefringence index tends to result in a poor spinning condition, and, on the other hand, a too high one tends to result in a poor stretch condition.

According to the method of the invention for producing polyethylene naphthalate fiber for industrial material, by further twisting or doubling obtained fibers, a desired fiber cord can be obtained. Further, giving an adhesive treatment agent onto the surface thereof is also preferable. Giving an RFL-based adhesive treatment agent as the adhesive treatment agent is best for a rubber enforcement application.

More specifically, such fiber cord can be obtained by adhering an RFL-based treating agent to the above-described polyethylene naphthalate fiber in a state of having been twisted according to an ordinary method, or in a state of no twisting, and then subjecting it to a heat treatment. Such fiber is formed into a treated cord capable of being suitably used for rubber reinforcement.

The polyethylene naphthalate fiber for industrial material thus obtained can be used with polymer to form a fiber/polymer composite. On this occasion, the polymer is preferably a rubber elastic body. Since the component is reinforced with the polyethylene naphthalate fiber for industrial material having physical properties excellent in fatigue resistance, even when it is wholly elongated and contracted, it exerts exceptional durability. In particular, the effect is great when the polyethylene naphthalate fiber for industrial material is used for reinforcing rubber, and is suitably used for tires, belts, hoses and the like.

EXAMPLES

Hereinafter, the invention is described further specifically on the basis of Examples. Respective items in Examples are measured by respective methods below.

(1) Intrinsic Viscosity

It was obtained from viscosity measured at 35° C. after dissolving a resin in a mixed solvent of phenol and orthodichlorobenzene (volume ratio 6:4).

(2) Strength, Rupture Elongation Degree, Intermediate Elongation Degree

The strength and elongation at rupture were measured with an autograph manufactured by Shimadzu Corporation according to JIS L-1070. The measurement was performed using a clamping device of capstan type for fiber, wherein the clamping length was 25 cm and drawing speed was 30 cm/min. The strength and the elongation degree at rupture, and an intermediate elongation degree at the stress of 4.0 cN/dtex were measured.

(3) Dry Thermal Contraction Ratio

It was measured at a temperature of 180° C. according to JIS L-1013-8.18.2.

(4) Terminal Modulus

The terminal modulus is the difference between a stress at an elongation degree before the rupture by 1% and the rapture stress, when a fiber is subjected to a tensile test. That is, the difference between the rapture stress and a stress (cN/dtex) at just before 10 of the rupture elongation degree is defined as the terminal modulus.

(5) Secondary Yield Point Elongation Degree

The elongation degree at the secondary yield point is obtained from the shape of the load elongation curve, as shown in FIG. 1. On this occasion, the secondary yield point elongation degree is a value of the elongation degree (strain) at the second inflexion point (secondary yield point) in a stress-strain curve (load elongation curve) when a fiber is subjected to a tensile test. In the tensile test, a fiber having a test length of 25 cm was measured at a speed of 30 cm/min, as was the case for the above-described (2) Strength.

(6) Disk Fatigue Test

A test piece, which had been prepared by embedding one adhesive-treated cord into an unvulcanized rubber and subjecting the same to a vulcanization treatment under such conditions as a pressure of 4.9 MPa (50 kgf/cm$^2$) at 140° C. for 40 minutes to adhere the cord to the rubber at the same time, was used for a disk fatigue (Goodrich method) according to JIS L-1017-1.3.2.2 to evaluate a strength-maintaining ratio (%) after 24-hour continuous running performed under conditions of an elongation ratio of +5.0% and compression ratio of under room temperature, which was defined as an after fatigue disk strength-maintaining ratio (%).

(7) Yarn Temperature

A noncontact type yarn temperature monitor "NONTACT II" (by Teijin Engineering Ltd.) was used to actually measure yarn temperature on the way of stretch.

(8) Birefringence Index

While using a polarization microscope, it was measured by a retardation method using a Perec Compensator with bromonaphthalene as an immersion liquid (see "Polymer Experimental Chemistry Course, Polymer Physical Properties 11 (Kobunshi Jikken Kagaku Koza, Kobunshi Bussei 11) (published by KYORITSU SHUPPAN CO., LTD)).

Example 1

A polyethylene naphthalate resin having an intrinsic viscosity of 0.64 was subjected to a solid phase polymerization under vacuum at 240° C. to give a chip having an intrinsic viscosity of 0.76. The chip was molten to a temperature of 320° C. with an extruder, which was discharged through a spinneret having 250 circular fine pores with a diameter of 0.6 mm. The polymer discharge amount was so adjusted that the fineness of the final stretched yarn was 1100 dtex.

The spun yarn was passed through a 250 mm heating zone provided just beneath the spinneret, to which cool wind at 25° C. was blown to be cooled and solidified. To the product, a spinning oil agent was given with a kiss roll, which was then taken off at a fiber spinning speed of 526 m/min. The birefringence index of the unstretched yarn was 0.007.

The taken off unstretched yarn was continuously fed to a stretch process without being once wound, then given prestretch between a takeoff roller and a first stretch roller, preheated on the heated first stretch roller, and subjected to a two-stage stretch between the first stretch roller—second stretch roller—third stretch roller. At the prestretch, the fiber temperature was 85° C., and the yarn tensile force was 0.80 cN/dtex. The yarn tensile force is a value obtained by dividing a tensile force of a fiber yarn in the process by the fineness of 1100 dtex of a finally obtained stretched yarn. Between the first stretch roller—second stretch roller, the fiber temperature was 162° C., and yarn tensile force was 0.20 cN/dtex.

The stretched fiber was heat-fixed on the third stretch roller heated at 230° C., which was then subjected to a constant length heat-treatment under tension between the fourth stretch roller, and wound at a speed of 3000 m/min. The total stretch magnification was 5.7. The obtained fiber was a polyethylene naphthalate fiber constituted of an ethylene-2,6-naphthalate unit, and had the strength of 8.4 cN/dtex, the secondary yield point elongation degree of 5.6%, and the terminal modulus, which is the difference between the rupture stress and the stress at the elongation degree of 1% before the rupture, was 0.29 cN/dtex. Other physical properties are collectively shown in Table 1.

Further, to the obtained stretched yarn, a Z twist of 490 turn/m was given, then two of which were coupled and given a S twist of 490 turn/twist to form a raw cord of 1100 dtex×2 yarns. The raw cord was dipped in a adhesive agent (RFL) liquid, which was subjected to a heat-treatment under tension at 200° C. for 2 minutes. The property of the treated cord, and the fatigue property of a disk having been prepared by embedding the treated cord into rubber and vulcanizing the same were measured to give such a high fatigue resistance as 93.8% in the disk maintenance ratio. As the RFL adhesive agent, an adhesive agent liquid, which had been formed as an adhesive agent liquid (resorcin-formalin-latex adhesive agent liquid) by mixing, at a ratio of 1:1, an A liquid prepared by aging 10 parts of resorcin, 15 parts of 35% formalin, 3 parts of 10% sodium hydroxide and 250 parts of water at ordinary temperature for 5 hours with a liquid prepared by mixing a 40% vinylpyridine SBR rubber latex and a 60% natural rubber latex, was used.

The surface temperature of respective rollers, yarn temperature, stretch magnification, stretch tensile force, fiber physical properties, adhesion fatigue properties and the like at this time are listed in Table 1.

Comparative Example 1

A test was repeated as in Example 1 except for changing the yarn tensile force at the prestretch to give Comparative Example 1. Fiber physical properties and production conditions are listed in Table 2.

Example 2, Comparative Example 2

Tests were repeated as in Example 1 except for changing the drawing roller temperature or turning off the heater (Comparative Example 2) to give Example 2 and Comparative Example 2. Fiber physical properties and production conditions are listed together in Table 1 for the Example and in Table 2 for the Comparative Example.

Examples 3, 4, Comparative Example 3

Tests were repeated as in Example 1 except for changing the first stretch roller temperature to give Examples 3, 4 and Comparative Example 3. Incidentally, when the first stretch roller temperature was further raised up to 200° C., yarn breakage occurred and stretch was not possible. Fiber physical properties and production conditions are listed together in Table 1 for the Examples and in Table 2 for the Comparative Example.

Examples 5, 6, Comparative Example 4

Tests were repeated as in Example 1 except for changing the stretch magnification to give Examples 5, 6 and Comparative Example 4. Incidentally, when setting the first stretch magnification to 4 same as in Comparative Example 4 and setting the second stretch magnification to 1.27 so as to give the total stretch magnification of 5.7, yarn breakage occurred and stretch was not possible. Fiber physical properties and production conditions are listed together in Table 1 for the Examples and in Table 2 for the Comparative Example.

Comparative Example 5

A test was repeated as in Example 1 except for not performing the second stretch to give Comparative Example 5. Fiber physical properties and production conditions are listed together in Table 2.

Comparative Example 6

A test was repeated as in Example 1 except for performing a relaxation heat treatment so that an after stretch ratio was minus 3% instead of a constant length heat-treatment under tension to give Comparative Example 6. Fiber physical properties and production conditions are listed together in Table 2.

TABLE 1

| | Example | | | | | |
|---|---|---|---|---|---|---|
| | 1 | 2 | 3 | 4 | 5 | 6 |
| Fiber physical properties | | | | | | |
| Strength | 8.4 | 8.25 | 8.6 | 8.2 | 8.6 | 8.2 |
| Secondary yield point elongation degree (a) % | 5.6 | 5.6 | 6.6 | 4.8 | 6.0 | 4.8 |
| Rupture elongation degree (b) % | 12.0 | 12.5 | 11.0 | 13.0 | 11.5 | 13.0 |
| Elongation degree difference (b) − (a) % | 6.4 | 6.9 | 4.4 | 8.2 | 5.5 | 8.2 |
| Terminal modulus cN/dtex | 0.29 | 0.23 | 0.44 | 0.19 | 0.46 | 0.25 |
| Intermediate elongation degree % | 3.1 | 3.1 | 3.0 | 3.2 | 3.0 | 3.2 |

TABLE 1-continued

| | Example | | | | | |
|---|---|---|---|---|---|---|
| | 1 | 2 | 3 | 4 | 5 | 6 |
| Dry thermal contraction ratio % | 5.5 | 5.3 | 5.6 | 5.3 | 5.8 | 5.2 |
| Production conditions | | | | | | |
| Prestretch conditions | | | | | | |
| Takeoff roller temperature ° C. | 90 | 120 | 90 | 90 | 90 | 90 |
| Yarn temperature ° C. | 85 | 112 | 85 | 85 | 85 | 85 |
| Yarn tensile force cN/dtex | 0.80 | 0.62 | 0.80 | 0.80 | 0.80 | 0.80 |
| Prestretch ratio % | 1 | 1 | 1 | 1 | 1 | 1 |
| First stretch condition | | | | | | |
| First stretch roller temperature ° C. | 170 | 170 | 140 | 180 | 170 | 170 |
| Yarn temperature ° C. | 162 | 162 | 135 | 173 | 162 | 162 |
| Yarn tensile force cN/dtex | 0.20 | 0.18 | 0.48 | 0.19 | 0.16 | 0.27 |
| First elongation magnification times | 5.0 | 5.0 | 5.0 | 5.0 | 4.6 | 5.4 |
| Second stretch condition | | | | | | |
| Second stretch roller temperature ° C. | 170 | 170 | 170 | 170 | 170 | 170 |
| Second elongation magnification times | 1.14 | 1.14 | 1.14 | 1.14 | 1.27 | 1.06 |
| Afger stretch ratio % | 0 | 0 | 0 | 0 | 0 | 0 |
| Total elongation magnification | 5.7 | 5.7 | 5.7 | 5.7 | 5.7 | 5.7 |
| Evaluation | | | | | | |
| Strength | 151 | 150 | 154 | 150 | 155 | 146 |
| Fatigue property (disk-maintaining ratio) | 93.8 | 91.4 | 87.6 | 92.3 | 88.2 | 88.0 |

TABLE 2

| | Comparative Example | | | | | |
|---|---|---|---|---|---|---|
| | 1 | 2 | 3 | 4 | 5 | 6 |
| Fiber physical properties | | | | | | |
| Strength | 8.35 | 8.2 | 8.4 | 6.8 | 7.6 | 7.9 |
| Secondary yield point elongation degree (a) % | 3.4 | 3.8 | 8.1 | 10.2 | 3.8 | 10.4 |
| Rupture elongation degree (b) % | 11.5 | 11.0 | 11.5 | 18.0 | 16.0 | 14.5 |
| Elongation degree difference (b) − (a) % | 8.1 | 7.2 | 3.4 | 7.8 | 12.2 | 4.1 |
| Terminal modulus cN/dtex | 0.56 | 0.51 | 0.56 | 0.12 | 0.67 | 0.15 |
| Intermediate elongation degree % | 3.0 | 3.1 | 3.0 | 4.2 | 3.8 | 5.2 |
| Dry thermal contraction ratio % | 5.5 | 5.5 | 5.5 | 5.0 | 5.2 | 3.8 |
| Production conditions | | | | | | |
| Prestretch conditions | | | | | | |
| Takeoff roller temperature ° C. | 90 | Off | 90 | 90 | 90 | 90 |
| Yarn temperature ° C. | 85 | 55 | 85 | 85 | 85 | 85 |
| Yarn tensile force cN/dtex | 3.03 | 3.30 | 0.80 | 0.80 | 0.80 | 0.80 |
| Prestretch ratio % | 5 | 1 | 1 | 1 | 1 | 1 |
| First stretch condition | | | | | | |
| First stretch roller temperature ° C. | 170 | 170 | 120 | 170 | 170 | 170 |
| Yarn temperature ° C. | 162 | 162 | 114 | 162 | 162 | 162 |
| Yarn tensile force cN/dtex | 0.36 | 0.40 | 0.53 | 0.08 | 0.73 | 0.20 |
| First elongation magnification times | 5.0 | 5.0 | 5.0 | 4.0 | 5.7 | 5.0 |
| Second stretch condition | | | | | | |
| Second stretch roller temperature ° C. | 170 | 170 | 170 | 170 | 170 | 170 |
| Second elongation magnification times | 1.14 | 1.14 | 1.14 | 1.14 | — | 1.14 |
| Afger stretch ratio % | 0 | 0 | 0 | 0 | 0 | −3 |
| Total elongation magnification | 5.7 | 5.7 | 5.7 | 4.56 | 5.7 | 5.53 |

TABLE 2-continued

| | Comparative Example | | | | | |
|---|---|---|---|---|---|---|
| | 1 | 2 | 3 | 4 | 5 | 6 |
| Evaluation | | | | | | |
| Strength | 152 | 151 | 153 | 136 | 138 | 148 |
| Fatigue property (disk-maintaining ratio) | 85.2 | 86.4 | 76.8 | 91.9 | 91.0 | 82.4 |

INDUSTRIAL APPLICABILITY

According to the invention, there are provided a polyethylene naphthalate fiber for industrial material with a little fatigue in a composite, a production method thereof, and a polyethylene naphthalate fiber cord for industrial material using the same.

The invention claimed is:

1. A polyethylene naphthalate fiber comprising an ethylene-2,6-naphthalate unit in 80% or more, wherein the polyethylene naphthalate fiber has a strength of 6 cN/dtex or more, a secondary yield point elongation degree of 8% or less, a rupture elongation degree is from 11 to 20%, a difference between the secondary yield point elongation degree and the rupture elongation degree is from 4 to 10%, and a terminal modulus, which is the difference between the rupture stress and a stress at an elongation degree before the rupture by 1%, of from 0.1 to 0.5 cN/dtex.

2. The polyethylene naphthalate fiber according to claim 1 wherein the intermediate load elongation degree at 4.0 cN/dtex is from 2 to 4%.

3. The polyethylene naphthalate fiber according to claim 1, wherein the thermal contraction ratio at 180° C. is from 3 to 7%.

4. A method for producing a polyethylene naphthalate fiber in which a fiber having been obtained by melt-spinning a polyethylene naphthalate containing an ethylene-2,6-naphthalate unit in 80% or more is subjected to multistage stretching without once being wound, wherein the temperature of the takeoff roller is in the range of from 85 to 130°, prestretch satisfying such conditions as the fiber temperature of from 80° C. to 120° C., and the prestretch tensile force of from 0.5 to 3.0 cN/dtex and the prestretch ratio on this occasion is from 0.2 to 4%, is performed between a takeoff roller and a first stretch roller, a first stretch satisfying such conditions as the fiber temperature of from 130° C. to 180° C. and stretch tensile force of not more than the prestretch tensile force is performed between the first stretch roller and a second stretch roller at the first stretch, the total stretch magnification including subsequent stretches is set to 5 or more, and finally heat-treatment under tension with a stretch ratio of from 0 to 2% is performed.

5. The method for producing a polyethylene naphthalate fiber according to claim 4, wherein the stretch tensile force at the first stretch is in the range of from 15 to 80% of the prestretch tensile force.

6. The method for producing a polyethylene naphthalate fiber according to claim 4, wherein the stretch tensile force at the first stretch is from 0.1 to 0.6 cN/dtex.

7. The method for producing a polyethylene naphthalate fiber according to claim 4, wherein the stretch speed is from 2000 to 4000 m/min.

8. The method for producing a polyethylene naphthalate fiber according to claim 4 provided with a heating zone immediately beneath the spinneret, the zone having a length of 300 mm or less.

9. The method for producing a polyethylene naphthalate fiber according to claim 6, wherein the fiber spinning speed is from 400 to 800 m/min.

10. The method for producing a polyethylene naphthalate fiber according to claim 4, wherein the birefringence index $\Delta n$ of the fiber before the stretch is from 0.001 to 0.01.

11. A polyethylene naphthalate fiber cord for industrial material, the fiber cord being a multifilament composed of the polyethylene naphthalate fiber as described in claim 1.

12. The polyethylene naphthalate fiber cord for industrial material according to claim 11, wherein an adhesive treatment agent is given onto the surface of the multifilament.

13. The polyethylene naphthalate fiber cord for industrial material according to claim 12, wherein the adhesive treatment agent is a resorcin-formalin latex adhesive agent.

14. The polyethylene naphthalate fiber cord for industrial material according to claim 11, wherein the number of twists of the multifilament is from 50 to 1000 turn/m.

15. The polyethylene naphthalate fiber according to claim 1 wherein a Silk factor, which is defined by (strength (cN/dtex))×(square root of elongation degree (%)), is in the range of from 22 to 30.

* * * * *